US007744446B1

(12) United States Patent
Vilmanis

(10) Patent No.: US 7,744,446 B1
(45) Date of Patent: Jun. 29, 2010

(54) SANDING APPARATUS

(76) Inventor: Ilmars Vilmanis, 7257 61st Ave. North, St. Petersburg, FL (US) 33709

( * ) Notice: Subject to any disclaimer, the term of this patent is extended or adjusted under 35 U.S.C. 154(b) by 0 days.

(21) Appl. No.: 12/196,070

(22) Filed: Aug. 21, 2008

(51) Int. Cl.
*B24B 21/06* (2006.01)

(52) U.S. Cl. ..... 451/296; 451/303

(58) Field of Classification Search ..... 451/296, 451/297, 303, 311, 489, 298
See application file for complete search history.

(56) References Cited

U.S. PATENT DOCUMENTS 1,025,836 A * 5/1912 Schimmel ..... 451/303
1,049,368 A * 1/1913 Jansen ..... 451/303
1,364,324 A * 1/1921 Siakel ..... 451/65
1,986,521 A * 1/1935 Oakley ..... 451/305
2,633,679 A * 4/1953 Cross et al. ..... 451/303
4,030,250 A 6/1977 Walker
4,115,957 A * 9/1978 Porth et al. ..... 451/355
4,231,193 A 11/1980 Siegel
4,416,090 A 11/1983 Jonasson
D275,014 S 8/1984 Haenel et al.
4,926,602 A 5/1990 Crouch
D341,844 S 11/1993 Arehart
6,146,254 A 11/2000 Wang

* cited by examiner

*Primary Examiner*—Robert Rose

(57) ABSTRACT

A sanding apparatus includes a plurality of posts each having an upper end and a lower end. The plurality of posts is four posts. A first horizontal support extends between two of the posts and a second horizontal support extends between another two of the posts. The first and second horizontal supports are vertically adjustable with respect to the posts. A table is mounted to and extends between the first and second horizontal supports. A belt sander is amounted to the posts. The table is positioned between the lower end of the posts and the belt sander. The table is selectively movable upwardly towards or downwardly from the belt sander.

10 Claims, 8 Drawing Sheets

SANDING APPARATUS

BACKGROUND OF THE INVENTION

Field of the Invention

The present invention relates to sanding devices and more particularly pertains to a new sanding device for allowing an item to be sanded to be lifted upwardly toward a sanding member.

SUMMARY OF THE INVENTION

The present invention meets the needs presented above by generally comprising a plurality of posts each having an upper end and a lower end. The plurality of posts is four posts. A first horizontal support extends between two of the posts and a second horizontal support extends between another two of the posts. The first and second horizontal supports are vertically adjustable with respect to the posts. A table is mounted to and extends between the first and second horizontal supports. A belt sander is amounted to the posts. The table is positioned between the lower end of the posts and the belt sander. The table is selectively movable upwardly towards or downwardly from the belt sander.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
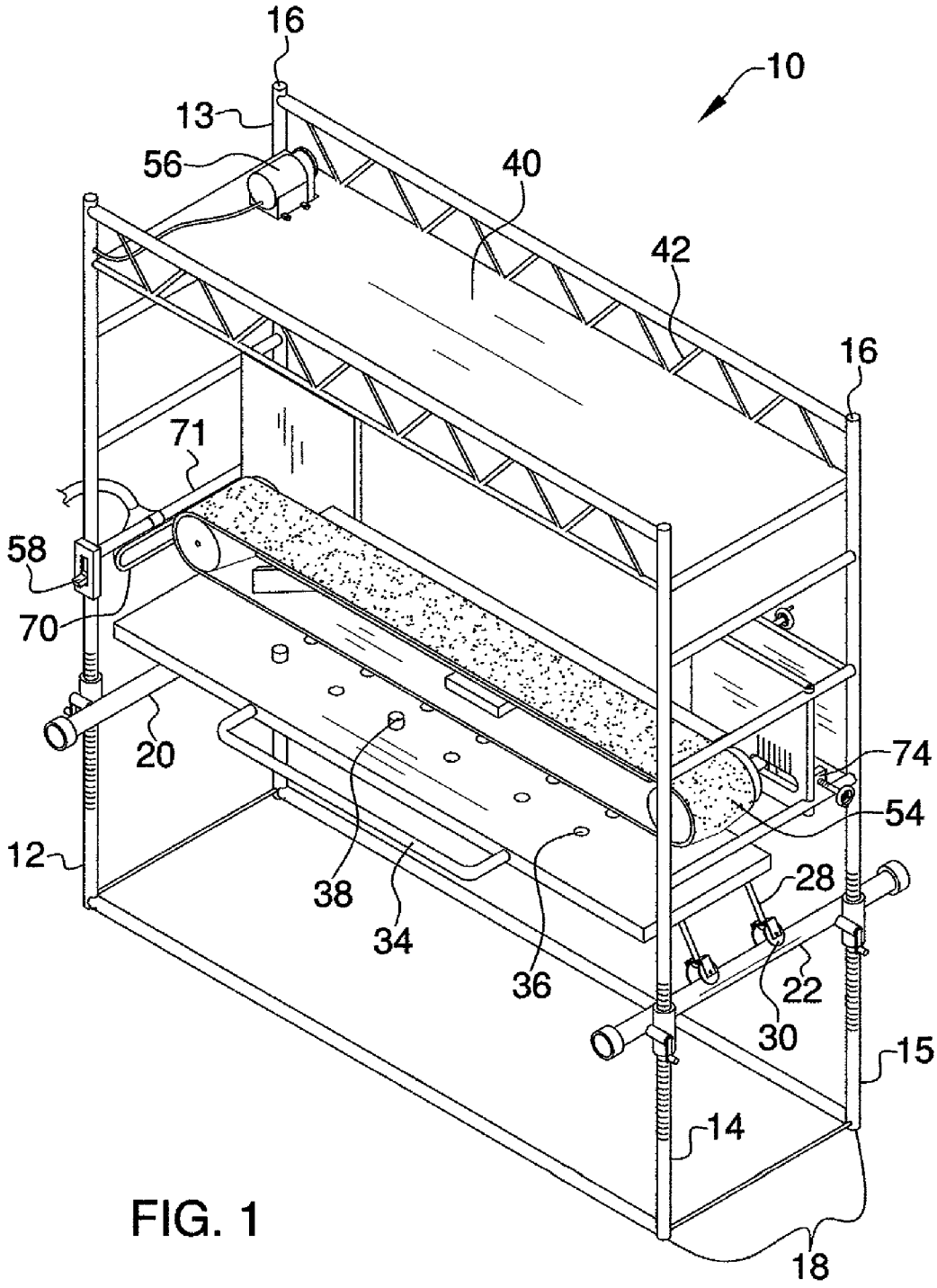
FIG. 1 is a front perspective view of a sanding apparatus according to the present invention.
Figure 2:
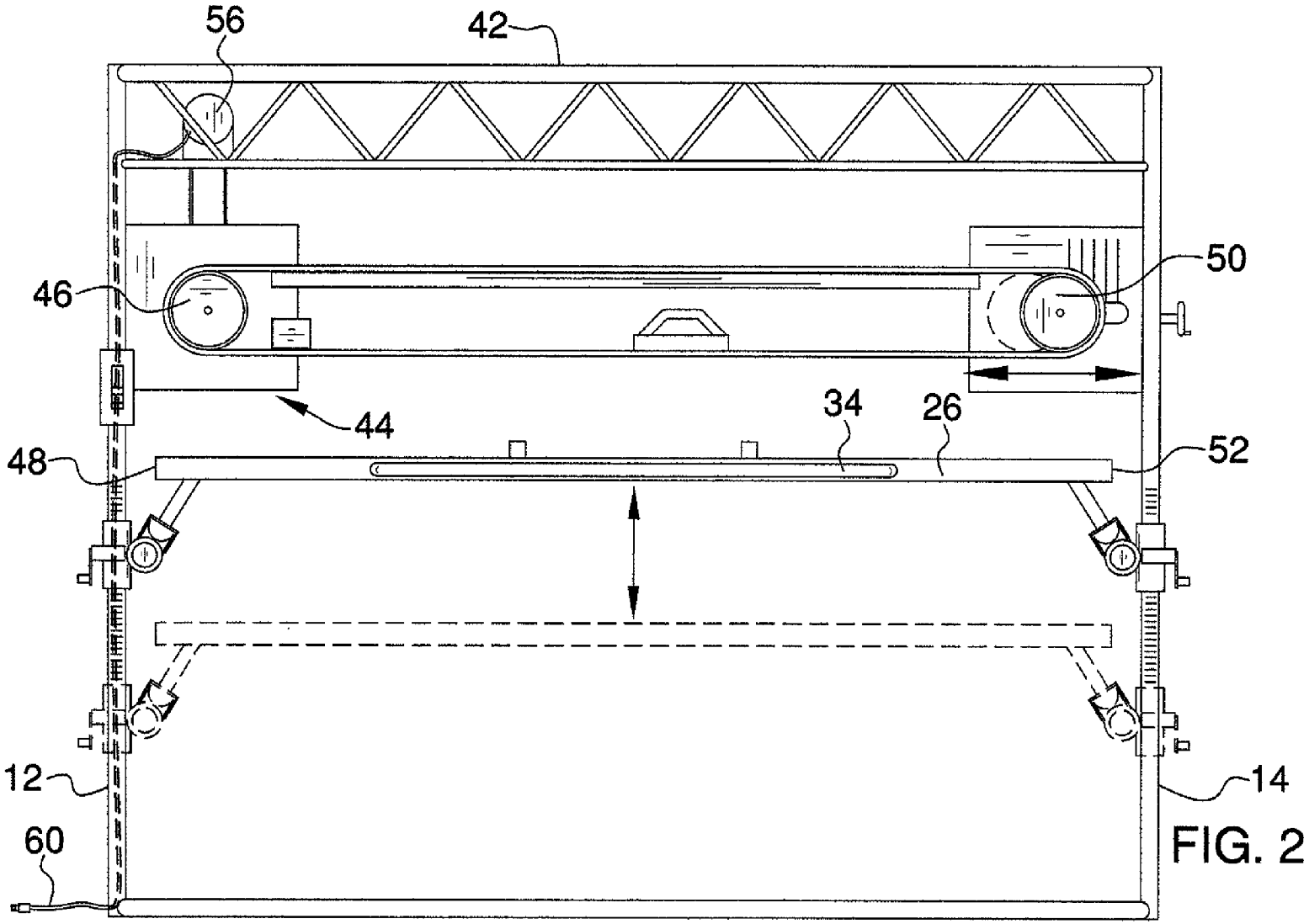
FIG. 2 is a front view of the present invention.
Figure 3:
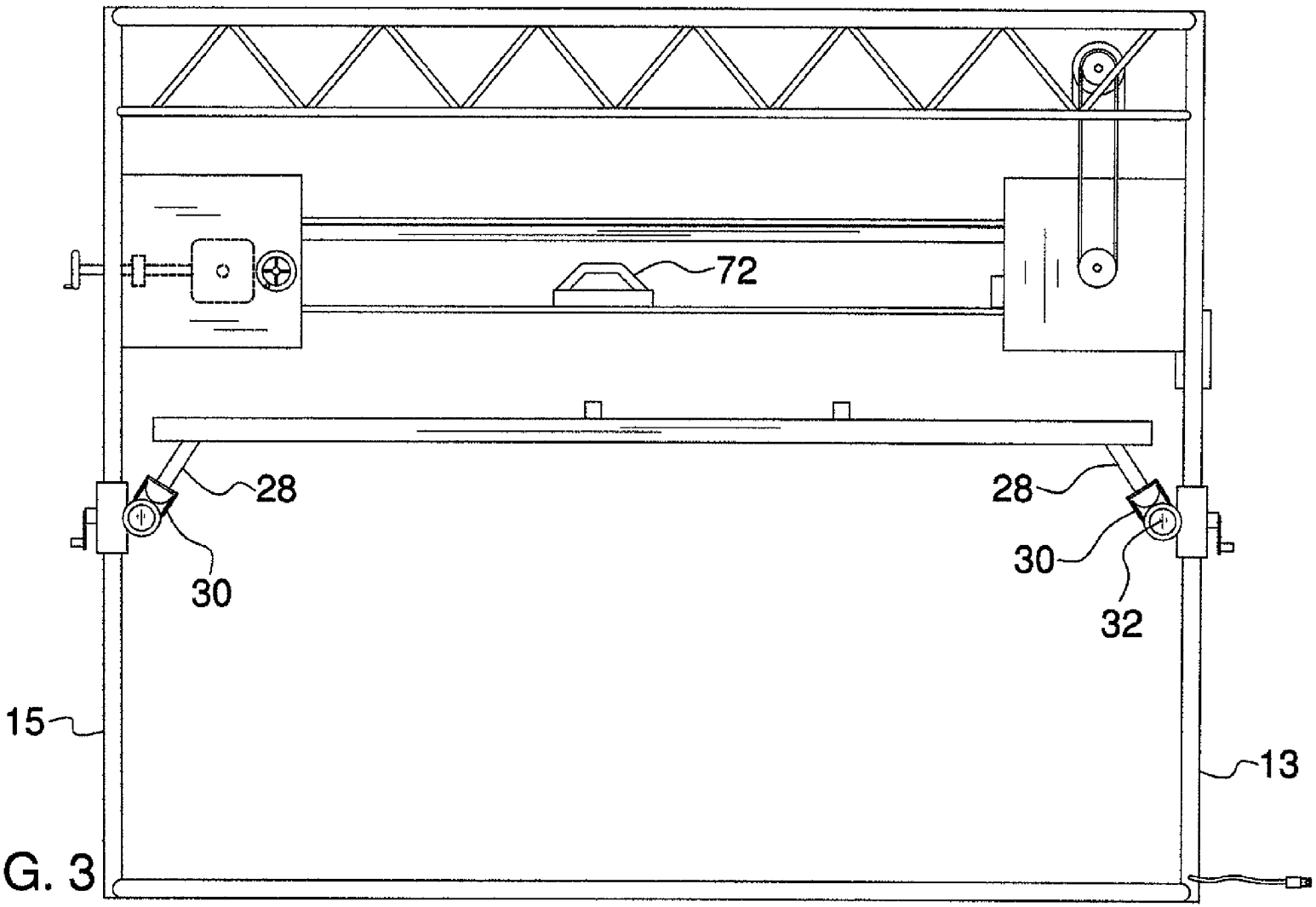
FIG. 3 is a rear view of the present invention.
Figure 4:
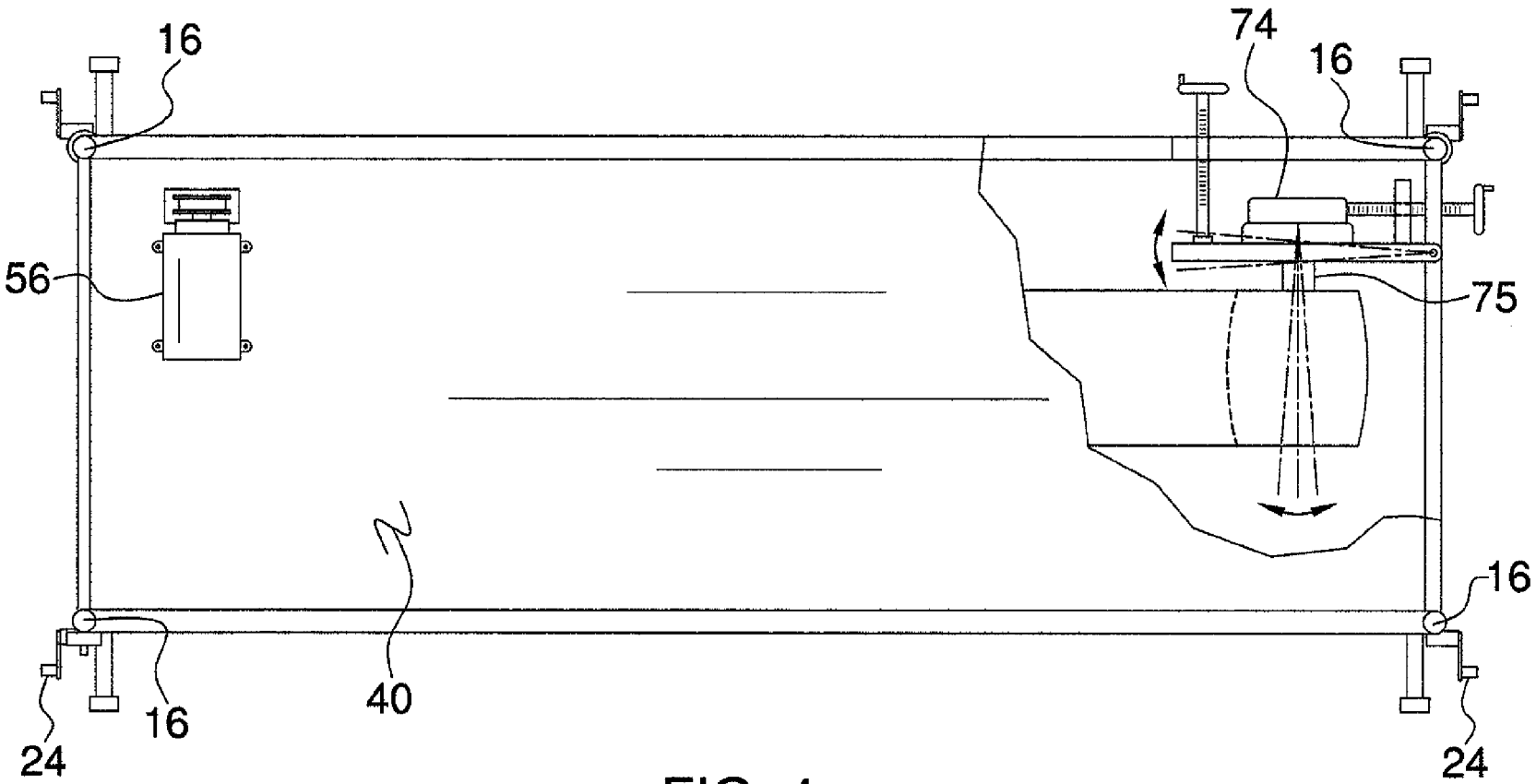
FIG. 4 is a top broken view of the present invention.
Figure 5:
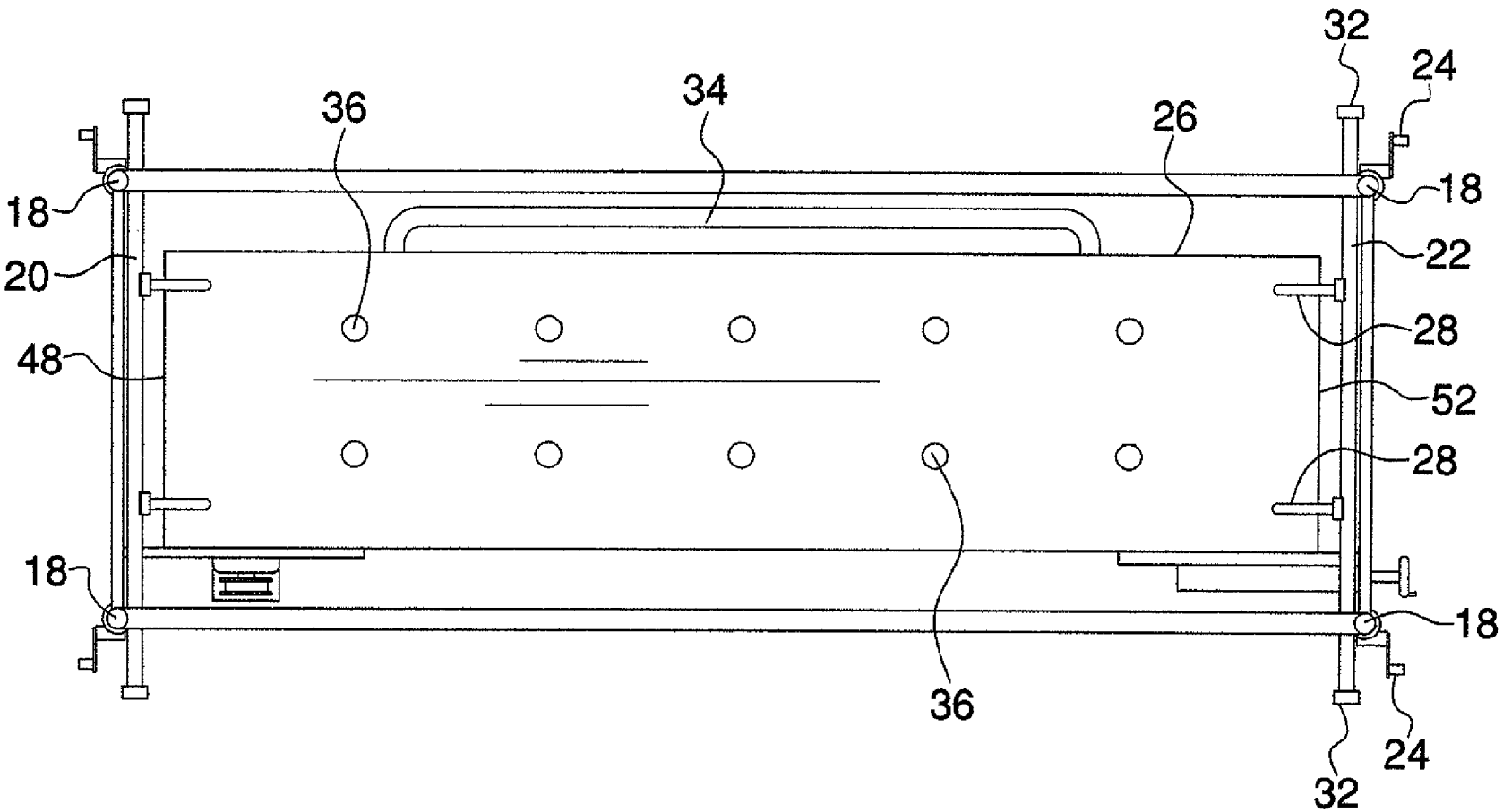
FIG. 5 is a bottom view of the present invention.
Figure 6:
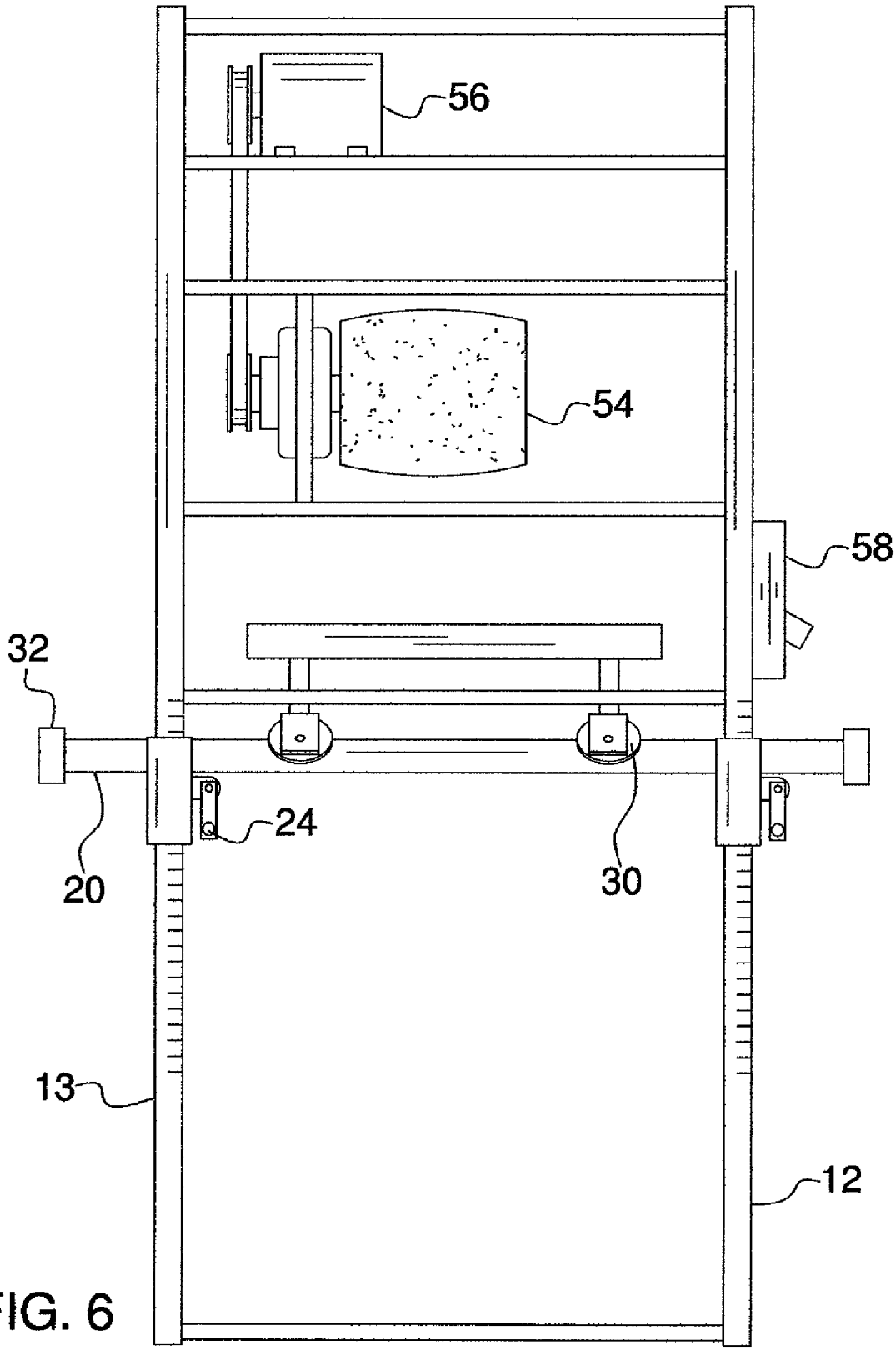
FIG. 6 is a left side view of the present invention.
Figure 7:
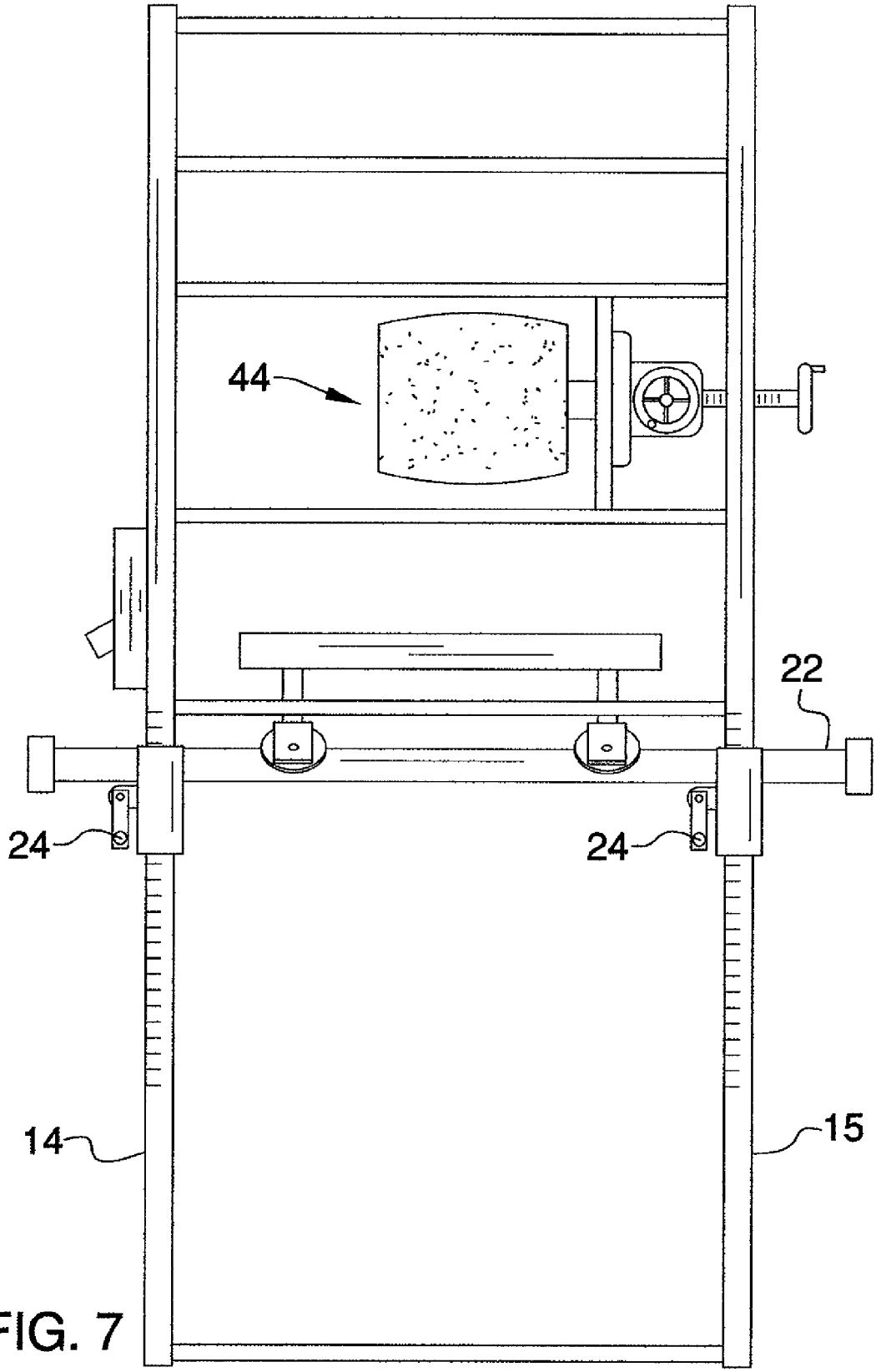
FIG. 7 is a right side view of the present invention.

With reference now to the drawings, and in particular to FIGS. 1 through 10 thereof, a new sanding device embodying the principles and concepts of the present invention and generally designated by the reference numeral 10 will be described.

As best illustrated in FIGS. 1 through 10, the sanding apparatus 10 generally comprises a plurality of posts 12, 13, 14 and 15 each having an upper end 16 and a lower end 18. The plurality of posts 12-15 is four posts. A first horizontal support 20 extends between two of the posts 12, 13 and a second horizontal support 22 extends between another two of the posts 14, 15. The first 20 and second 22 horizontal supports include cranks 24 engaged with the posts 12-15 to allow the first 20 and second 22 horizontal supports to be vertically adjustable with respect to the posts 12-15.

A table 26 is mounted to and extends between the first 20 and second 22 horizontal supports. The table 26 is selectively movable toward or away from a front pair 12, 14 of the posts. In particular the table 26 includes a plurality of legs 28 having bottom ends comprising wheels 30 that rotatably engage the first 20 and second 22 horizontal supports. The first 20 and second 22 horizontal supports include enlarged ends 32 to prevent the wheels 30 from rolling off of the first 20 and second 22 horizontal supports. A handle 34 is positioned on the table 26 to selectively move the table 26. The table 26 may have a plurality of apertures 36 extending therethrough for receiving bracing members 38. An upper shelf 40 is attached to each of the posts 12-15 adjacent to the upper ends 16 of the posts 12-15 and guard rails 42 may be positioned on the shelf 40.

A belt sander 44 is amounted to the posts 12-15. The table 26 is positioned between the lower end 18 of the posts 12-15 and the belt sander 44. The belt sander 44 includes a first hub 46 positioned over a first end edge 48 of the table 26 and a second hub 50 positioned over a second end edge 52 of the table 26. An abrasive belt 54 is mounted on and extends between the first 46 and second 50 hubs. A motor 56 is mechanically coupled to the first hub 46 and rotates the first hub 46 when the motor 56 is turned on. An actuator 58 electrically coupled to the motor 56 is mounted on one of the posts 12-15 and a power plug 60 for plugging into an electrical outlet is electrically coupled to the motor 56. An access space 62 is defined between an upper portion 64 of the abrasive belt 54 and a lower portion 66 of the abrasive belt 54. The first 46 and second 50 hubs are positioned in the access space 62. Each of the hubs 46, 50 has a pair of outer edges 68. Each of the hubs 46, 50 has a decreasing diameter from a central area of the hubs 46, 50 to an associated one of the outer edges 68. A vacuum assembly 70 may be mounted on a support bar 71 attached to the posts 12-15 to suction sawdust from the belt sander 44.

Figure 8:
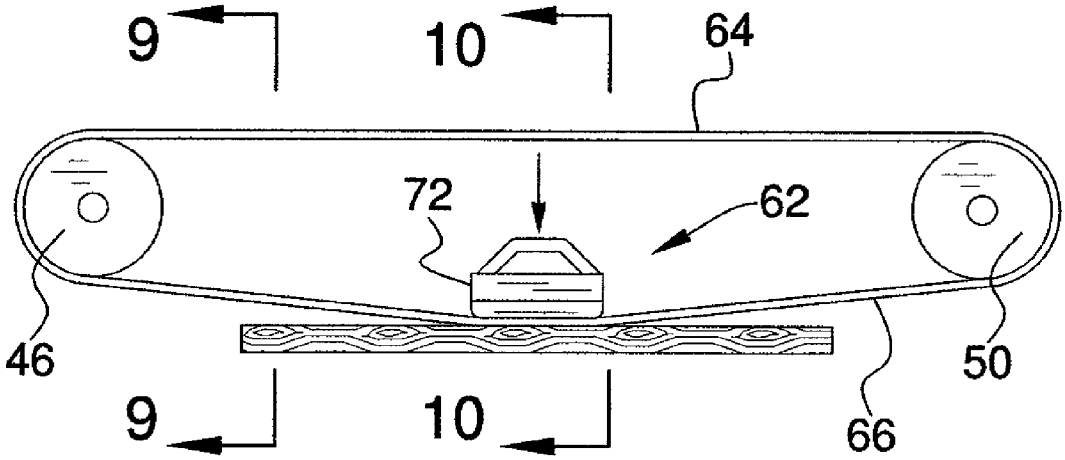
FIG. 8 is a front view of a sander of the present invention.
Figure 9:
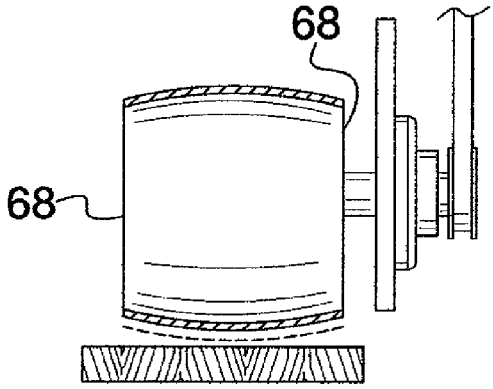
FIG. 9 is a cross-sectional view taken along line 9-9 of FIG. 8 of the present invention.
Figure 10:
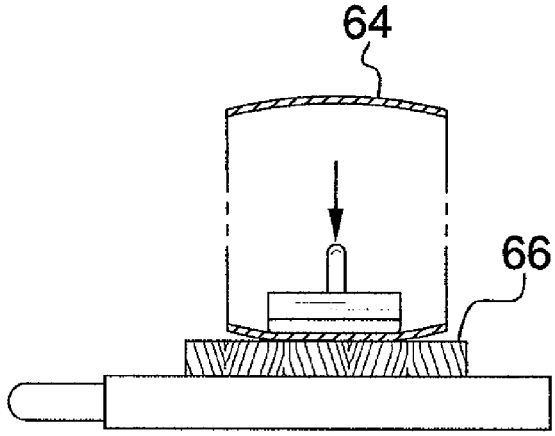
FIG. 10 is a cross-sectional view taken along line 10-10 of FIG. 8 of the present invention.

A block member 72 is positionable in the receiving space 62 to bias the lower portion 66 of the belt toward the table 26. The block member 72 may be uses as shown in FIG. 8 to bias the belt 54 toward an item being sanded.

An adjusting assembly 74 secures the second hub 50 to the posts 12-15. The adjusting assembly 74 is coupled to an axle 75 of the second hub 50 and is configured to move the second hub 50 toward or away from the first hub 46 to adjust the tension on the belt 54 along its length. The adjusting assembly 74 is also configured to allow angle adjustment of the second hub 50 with respect to the first hub 46 to adjust the tension of the belt 54 along its width.

In use, an item to be sanded, such as a portion of wood, is placed on the table 26 and the table's 26 height and position are adjusted as needed. The belt sander 44 is then turned on and the block member 72 used to urge the belt onto the wood to perform selected sanding of the wood.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sanding apparatus comprising:

a plurality of posts each having an upper end and a lower end, said plurality of posts being four posts, a first horizontal support extending between two of said posts and a second horizontal support extending between another two of said posts, said first and second horizontal supports being vertically adjustable with respect to said posts;

a table being mounted to and extending between said first and second horizontal supports, said table having a first lateral edge and a second lateral edge;

a plurality of legs each having an attached end attached to said table, a first pair of said legs being attached to said table adjacent to said first lateral edge and a second pair said legs being attached to said table adjacent to said second lateral edge, each of said legs having a bottom end comprising a wheel, said bottom ends of said first pair rotatably engaging said first horizontal support, said bottom ends of said second pair rotatably engaging said second horizontal support, said legs of said first pair being angled outwardly away from said table from corresponding ones of said attached ends to said bottom ends, said legs of said second pair being angled outwardly from said table from associated ones of said attached ends to said bottom ends; and a belt sander being mounted to said posts, said table being positioned between said lower end of said posts and said belt sander, said table being selectively movable upwardly towards or downwardly from said belt sander.

2. The apparatus according to claim 1, wherein said table is selectively movable toward or away from a front pair of said posts, a handle being positioned on said table to selectively move said table.

3. The apparatus according to claim 1, further including:

said belt sander includes a first hub positioned over a first end edge of said table and a second hub positioned over a second end edge of said table, an abrasive belt being mounted on and extending between said first and second hubs, a motor being mechanically coupled to said first hub and rotating said first hub when said motor is turned on, an access space being defined between an upper portion of said abrasive belt and a lower portion of said abrasive belt, said first and second hubs being positioned in said access space; and a block member being positionable in said receiving space to bias said lower portion of said belt toward said table, said block member being movable in forwards, rearwards and laterally along said belt in a horizontal plane and is removable from said receiving space.

4. The apparatus according to claim 3, wherein each of said hubs has a pair of outer edges, each of said hubs having a decreasing diameter from a central area of said hubs to an associated one of said outer edges.

5. The apparatus according to claim 3, further including an adjusting assembly securing said second hub to said posts, said adjusting assembly being configured to move said second hub toward or away from said first hub.

6. The apparatus according to claim 5, wherein said adjusting assembly is configured to allow angle adjustment of said second hub with respect to said first hub.

7. The apparatus according to claim 1, further including an upper shelf being attached to each of said posts adjacent to said upper ends of said posts.

8. A sanding apparatus comprising:

a plurality of posts each having an upper end and a lower end, said plurality of posts being four posts, a first horizontal support extending between two of said posts and a second horizontal support extending between another two of said posts, said first and second horizontal supports being vertically adjustable with respect to said posts;

a table being mounted to and extending between said first and second horizontal supports, said table being selectively movable toward or away from a front pair of said posts, a handle being positioned on said table to selectively move said table;

a belt sander being mounted to said posts, said table being positioned between said lower end of said posts and said belt sander, said belt sander including a first hub positioned over a first end edge of said table and a second hub positioned over a second end edge of said table, an abrasive belt being mounted on and extending between said first and second hubs, a motor being mechanically coupled to said first hub and rotating said first hub when said motor is turned on, an access space being defined between an upper portion of said abrasive belt and a lower portion of said abrasive belt, said first and second hubs being positioned in said access space, each of said hubs having a pair of outer edges, each of said hubs having a decreasing diameter from a central area of said hubs to an associated one of said outer edges;

a block member being positionable in said receiving space to bias said lower portion of said belt toward said table, said block member being movable in forwards, rearwards and laterally along said belt in a horizontal plane and is removable from said receiving space;

an adjusting assembly securing said second hub to said posts, said adjusting assembly being configured to move said second hub toward or away from said first hub, said adjusting assembly being configured to allow angle adjustment of said second hub with respect to said first hub; and an upper shelf being attached to each of said posts adjacent to said upper ends of said posts;

said table having a first lateral edge and a second lateral edge; and a plurality of legs each having an attached end attached to said table, a first pair of said legs being attached to said table adjacent to said first lateral edge and a second pair said legs being attached to said table adjacent to said second lateral edge, each of said legs having a bottom end comprising a wheel, said bottom ends of said first pair rotatably engaging said first horizontal support, said bottom ends of said second pair rotatably engaging said second horizontal support, said legs of said first pair being angled outwardly away from said table from corresponding ones of said attached ends to said bottom ends, said legs of said second pair being angled outwardly from said table from associated ones of said attached ends to said bottom ends.

9. The apparatus according to claim 8, wherein said table has a plurality of apertures extending therein, each of a plurality of bracing members being removably extendable into said apertures.

10. The apparatus according to claim 1, wherein said table has a plurality of apertures extending therein, each of a plurality of bracing members being removably extendable into said apertures.

* * * * *